United States Patent [19]

Brand et al.

[11] Patent Number: 4,859,428

[45] **Date of Patent: * Aug. 22, 1989**

[54] APPARATUS FOR THE CONTAINMENT OF MONOLITHIC CATALYSTS

[75] Inventors: Reinhold Brand, Moembris; Bernd Engler, Hanau; Peter Kleine-Moellhoff; Edgar Koberstein, both of Alzenau, all of Fed. Rep. of Germany

[73] Assignee: Degussa Aktiengesellschaft, Frankfurt am Main, Fed. Rep. of Germany

[ * ] Notice: The portion of the term of this patent subsequent to Mar. 21, 2006 has been disclaimed.

[21] Appl. No.: 7,884

[22] Filed: Jan. 28, 1987

[30] Foreign Application Priority Data

Feb. 1, 1986 [DE] Fed. Rep. of Germany ... 8602600[U]

[51] Int. Cl.[4] ..... B01J 8/02

[52] U.S. Cl. ..... 422/179; 55/350; 55/507; 211/13; 211/49.1; 422/180; 422/311

[58] Field of Search ..... 422/171, 173, 179, 180, 422/196, 221, 222, 311; 55/350, 502, 507, 509, 511, 483, 484; 211/13, 49.1

[56] References Cited

U.S. PATENT DOCUMENTS

| | | | |
|---|---|---|---|
| 1,426,196 | 8/1922 | Jordahl | 55/483 |
| 3,487,625 | 1/1970 | Lucas | 55/484 |
| 3,721,067 | 3/1973 | Agnew | 55/350 |
| 4,048,363 | 9/1977 | Langer et al. | 422/179 |
| 4,324,701 | 4/1982 | Honda et al. | 422/180 |
| 4,335,023 | 6/1982 | Dettling et al. | 422/180 |
| 4,416,695 | 11/1983 | Montirth | 422/180 |
| 4,419,108 | 12/1983 | Frost et al. | 422/180 |
| 4,544,525 | 10/1985 | Honda et al. | 422/311 X |
| 4,580,381 | 4/1986 | Sodec et al. | 55/484 |
| 4,636,232 | 1/1987 | McDowell | 55/502 |
| 4,663,934 | 5/1987 | Sickels | 422/179 |

FOREIGN PATENT DOCUMENTS

| | | | |
|---|---|---|---|
| 343762 | 2/1960 | Switzerland | 55/483 |

*Primary Examiner*—Barry S. Richman
*Assistant Examiner*—Jill Johnston
*Attorney, Agent, or Firm*—Beveridge, DeGrandi & Weilacher

[57] ABSTRACT

A device for the support of ceramic catalyst monoliths especially of square cross section as well as for the combination of several of such monoliths into one package. It is formed of an elastic gasket attached on one or both monolith ends and a metal frame attached on the gasket under pressure. The frame has recesses on two adjacent lateral surfaces, and at the two opposite lateral surfaces it has projections which can engage interlockingly into the recesses of adjacent frames.

18 Claims, 1 Drawing Sheet

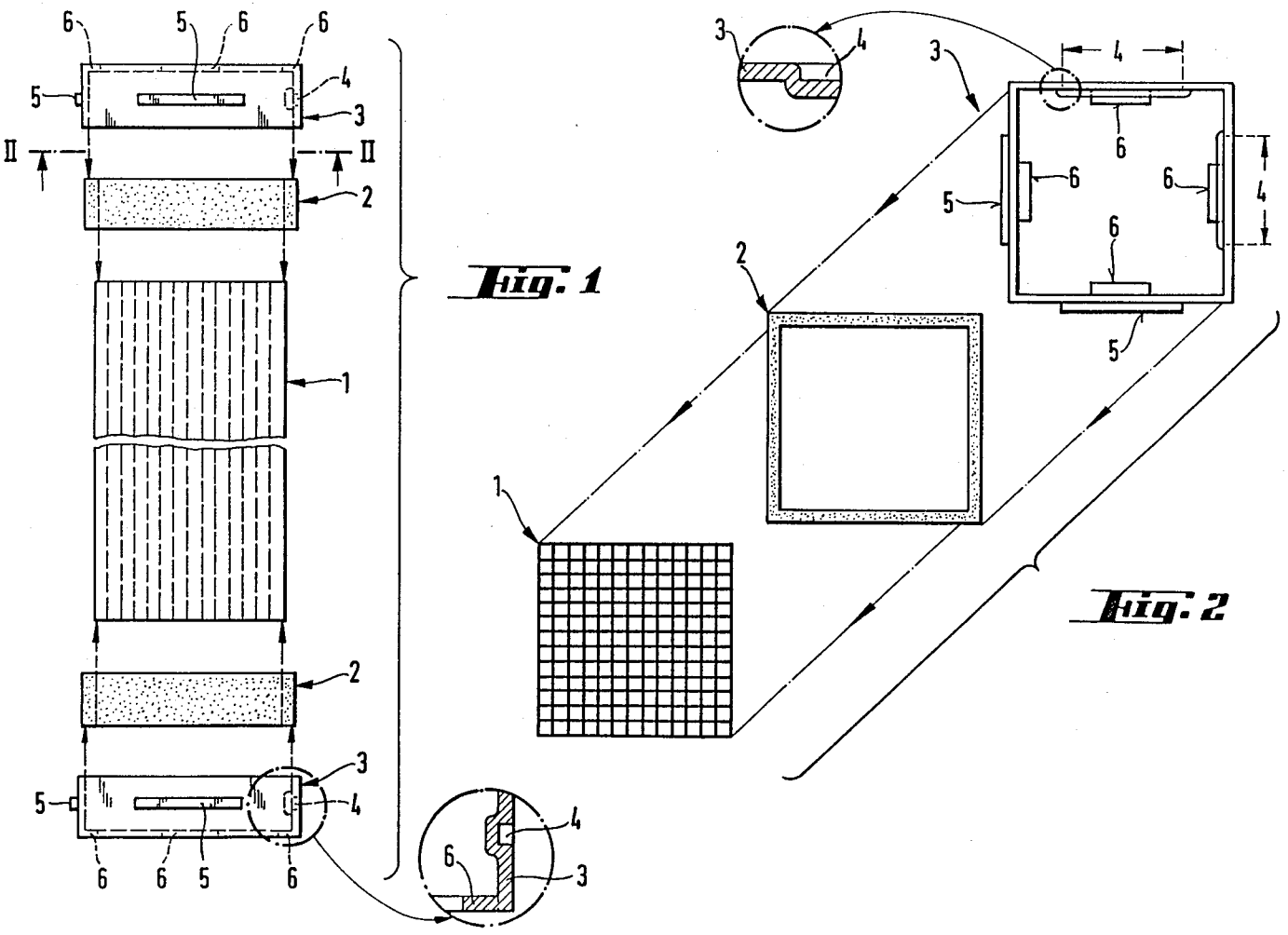
007884

APPARATUS FOR THE CONTAINMENT OF MONOLITHIC CATALYSTS

The present invention relates to an apparatus for the support and containment of monolithic ceramic catatlyst elements, having four cornered cross-sectional perimeters, used for the reduction of the harmful substances in combustio products emitted by industrial installations, for example, combustion apparatus foro heat power plants. The present invention also relates to the combination of such catalyst elements into a package.

Ceramic monoliths, because of their risk of breakage under extreme operating conditionsn (shocks, pressure surges, temperature fluctuations), require a secure and shock absorbing attachment. Since these monoliths cannot be produced in the large size that is sometimes desired for a particular installation, there furthermore exists the necessity of combining several of such elements in an array or series in order to be able to handle the large volumes of gas flowing per unit of time as is the case of, for example, in exhaust gases from industrial power plants.

According to the present invention, an apparatus for the containment of monolitthic ceramic ctalyst elements having four-cornered cross-sectional perimeters used for the after-treatment of the exhaust gas of combustion installation, as well as for the combination of said elements into a single package, includes an elastic buffer gasket generally corresponding to the outside shape of the catalyst element and capable of surrounding the edges of the element in a formfitting manner.

The present invention also includes a metal frame generally corresponding to the outside shape of the catalyst element and buffer gasket, and dimensioned so as to encircle the buffer gasket and hold it in its intended position surrounding the edges of the element. Furthermore, the inside free-cross-sectional are of the frame is larger then the front surface of the catalyst element facing the frame, and smaller than the sum of the front surface areas of the catalyst element and the buffer gasket or equal to the sum of these front surface areas.

In addition the depth of the frame and the length of the buffer gasket in the direction parallel to he axis of the apparatus correspond to at least 1/50 of the length of the catalyst element along the main axis thereof.

Moreover the two adjacent lateral surfaces of the frame always have recesses or openings in symmetric arrangement or grooves projecting inward and the two remaining lateral surfaces opposite to the first lateral surfaces have projections which can engage in a formfitting manner with the recesses or grooves of adjacent frames.

The buffer gasket can be formed of, for example, mineral fibers, ceramic fibers, wire mesh or other high temperature resistant, elastic raw materials. After the gasket has been positioned onto the momolith, the metal frame is positioned over the gasket, whereby the elastic gasket may be compressed. The dimensions of the gasket are such that in its relaxed state, the gasket is preferably slightly larger than can be accommodated without compression by the frame. This compressing may also be achieved or strengthened by a gasket material which expands when it heats up. Such a material is for example a so-called thermo-expandable mica mat as is distributed for example by the 3M Company under the name INTERAM®. The required heat treatment may be carried out after mounting, or can be accomplished during operation by exposure of the gasket to the hot exhaust gases, for example, of a hot flue gas. In either case, the gasket forms a snug fit between the frame and the catalyst element.

If the catalyst is to be exposed to operating conditions with which the frictionally engaged connection between monolith and buffer gasket, on the one hand, and buffer gasket and metal frame, on the other hand, may not be able to withstand, then the frame at one front side is provided with security means, which encircle the edge of the catalyst front surface and by this formfitting configuration thereby prevent an axial shifting of the catalyst element.

According to an advantageous form of an embodiment of the invention, the metal frame at its front side extends inwardly in a continuous surface around all four sides to provide a flange to hold the element. Or the frame edge can be divided into several "tongues" to provide a border zone around the front surface of the catalyst element. These tongues extend towards the center of the frame.

In the case of vertically oriented shorter catalyst elements, it will often suffice to support the catalyst elementn only in its lower section. In the case of longer catalytic elements, for a stronger load bearing or horizontal attachment of the elements, a mounting support on both sides is advisable.

According to the invention therefore it will be possible to provide the combination comprsing buffer gasket and metal frame for an attachment at least at one terminal end section of the catalyst element.

The present invention is described in further detail hereinafter and is illustrated in the drawings wherein:

FIG. 1 is an exploded view of one embodiment of the invention; and

FIG. 2 is a front view of an embodiment of the invention.

Described in further detail with reference to FIG. 1, there is shown in an exploded view a 1 m long monolithic catalyst element (1) of square cross section (length of thet edges 150 mm), which over its entire length contains a multiplicity of square flow channels in which the exhaust gas to be treated flows and comes into contact with the catalyst. The catalyst can be a material component of the monolithic element or the monolith can be formed of any of the well known ceramic substances according to the state of the art and the channels can be of any desired configuration. A buffer gasket (2) of 3 cm length made of elasltic wire mesh with slightly smaller free inside cross section area than the front surface area of the monolith (149 mm×149 mm) is forced upon the latter in such a manner that the outside front surface of the gasket terminates flush with the front surface of the monolith.

A frame (3) with a depth of 3 cm made of temperature resistant steel (for example V2A) is dimensioned to generally correspond to the outside shape of monolith (1) and gasket (2) and has a slightly smaller inside free cross secttion area than the sum of the front surfaces of the catalyst element (1) and buffer gasket (2) (158 mm×158 mm). The frame (3) is provided at two adjacent lateral surfaces with rectangular recesses (4) in a corresponding shape and arrangement (dimensionsn 10 mm×100 mm). The recesses can also be in the form of openings or holes that pass through the frame. The two remaining lateral surfaces located opposite the lateral surface with recesses (4) are provided with rectangular projecttions (5) which can engage in a formfitting manner or mating arrangement with the above described recesses (4) of adjacent frames to provide a package of contained catalyst elements.

At the outside edge of the metal frame (3), there is provided for each end of the frame, a projecting metal edge or flange (6) attached to the frame for supporting the edge zone of the front surface of the monolith and which projects inwardly towards the center of the frame perpendicularly to aforementioed lateral surfaces. The dimension of the metal edge (6) can be 6 mm, for example.

The frame is forced over the buffer gasket during the mounting and is pushed up on it as far as possible until the projecting metal edge (6) come into contact with the monolith (1) end surface.

The monolith (1) equipped on both ends with the supporting frame arrangement may then be plugged together with other monoliths similarly equipped by way of the groove/projection connection 4/5 into a catalyst package.

In FIG. 2, there is shown a projection view of the catalyst element (1), a buffer gasket (2) and a frame (3).

Further variations of the present invention will become apparentn from the foregoing and are intended to be encompassed by the claims appended hereto.

We claim:

1. An apparatus for the containment of at least one monolithic catalyst element having a quadrilateral cross-section perimeter, comprising:

(a) at least one elastic buffer gasket (2) having a shape generally conforming to the outside shape of the catalyst element (1) to be contained by said apparatus and adaptable to a formfitting configuration with respect to the catalyst element to be contained by said apparatus;

(b) at least one metal frame (3) having a general configuration corresponding to the ouside shape of the catalyst element to be contained by said apparatus, the inside free cross-sectional area of said frame being greater than the front surface of the catalyst element to be contained by said apparatus and said buffer gasket, (c) said frame and said buffer gasket having a depth dimension parallel to the longitudinal median axis of the catalyst to be contained by said apparatus, said depth dimension corresponding to at least 1/50 of the entire length of the catalyst element to be contained by said apparatus, (d) said frame having a first exterior lateral surface parallel to said axis, said first exterior lateral surface having a recess (4) formed therein, said frame having a second exterior lateral surface opposite said first exterior lateral surface, said second exterior lateral surface having a projection (5) formed therein that is engageable in a form fitting manner into a recess of the form of the recess in the first exterior lateral surface of said frame.

2. The apparatus according nto claim 1, wherein said at least one metal fram e(3) has a front side which has formed therein at least one inwardly directed projection to thereby form a marginal zone (6) to support an edge zone of the front surface of the catalyst element to be contained by said apparatus.

3. The apparatus according to claim 1 wherein said frame extends about the periphery of the catalyst to be contained in said apparatus such that the front face of the catalyst to be contained remains essentially uncovered.

4. An apparatus for the containment of at least one monolithic catalyst element having a quadrilateral cross-sectional perimeter, comprising:

at least one elastic buffer gasket having an external surface, an internal surface and a forward and a rearward side edge with the internal surface of said gasket adapted to fit about the outer peripheral surface of the catalyst to be contained in said apparatus;

at least one frame member having an external surface, an internal surface and a forward and a rearward side edge, with the internal surface of said at least one frame member having essentially the same configuration as the external surface of said at least one gasket and the cross-sectional area defined by the internal surface of said at least one frame member being less than the cross-sectional area of the external surface of said gasket when said gasket is in place about the outer peripheral surface of the catalyst to be contained in said apparatus, the cross-sectional area defined by the internal surface of said at least one frame member being greater than the cross-sectional area of the peripheral surface of the catalyst to be contained in said apparatus, said at least one frame member having at least one recess formed in its external surface and, at a position on the external surface of said at least one frame member which is opposite to the at least one recess, at least one projection extending outwardly from the external surface of said at least one frame member and being of a form which is engageable in form fitting manner witth any recess in the shape of the at least one recess formed in the external surface of said frame member.

5. An apparatus according to claim 4 wherein a line extending on the exterior surface perpendicularly between the forward and rearward side edges of said at least one frame member is of a length which is at least 1/50 of the entire length of the catalyst to be contained in said apparatus.

6. An apparatus according to claim 4 wherein said at least one frame member includes at least one projecting edge member positioned at the forward side edge of said at leasat one frame member and extending inwardly from the external surface of said at least one frame member, past the internal surface and into the free cross sectional area defined by the internal surface of said at least one frame member such that said projecting edge member prevents both the catalyst to be contained in such apparatus and said gasket from extending past the plane defined by the forward side edge of said at least one frame member.

7. An apparatus according to claim 6 wherein both the internal and external surfaces of said at least one frame member are rectangular in cross-section and said frame member includes four frame elements which form said rectangular frame member.

8. An apparatus according to claim 7 wherein there are two recesses each formed in the external surface of said apparatus, and each positioned on one of the four frame elements forming the at least one rectangular frame member.

9. An apparatus according to claim 8 wherein there are two of said projections, one each on the remaining two of the four frame elements of said at least one rectangular frame member and said projections being positioed on frame elements which are opposite to those frame elements in which the recesses are formed.

10. An apparatus according to claim 7 wherein there are four of said projecting edge members one on each frame element of said at least one rectangular frame member.

11. An apparatus according to claim 4 wherein there are a plurality of metal frame and gasket combinations with each combination positioned adjacent the other and each metal frame having its recess or projection fittingly engaged with a corresponding recess or projection of an adjacent metal flrame.

12. An apparatus for the containment of at least one monolithi catalyst element having a quadrilateral cross-sectional perimeter, comprising:

two elastic buffer gaskets each having an external surface, an internal surface and a forward and a rearward side edge, with the internal surface of each of said gaskets adapted to fit over the outer periphery of respective ends of the catalyst to be contained in said apparatus;

two metal frames each having an external surface, an internal surface and a rearward and a forward side edge, each of said metal frames being adapted to fit over a respective one of said gaskets, with the internal surface of each of the two metal frames having essentially the same configuration as the external surface of each of said gaskets, and the cross-sectional area defined by the internal surface of each respective metal frame being less than the cross-sectional area defined by the exterior surface of each of said gaskets when said gaskets are positioned on the respective ends of the catalyst, but greater than the cross-sectional area defined by the exterior surface of the respective ends of the catalyst to be contained in said apparatus;

each of said metal frames having at least one recess formed in its external surface and, at a position on the external surface of each respective metal frame which is opposite to the at least one recess, at least one projection extending outwardly from the external surface of each of said metal frames and being of a form which is engageable in a form fitting manner with any recess in the shape of said at least one recess.

13. An apparatus according to claim 12 wherein a line extending on the exterior surface perpendicularly between the forward and rearward side edges of each respective one of said metal frames is of a length which is at least 1/50 of the end to end length of the catalyst to be contained in said apparatus.

14. An apparatus according to claim 12 wherein each metal frame includes at least one projecting edge member positioned at the forward side edge of each metal frame and extending inwardly from the external surface of each metal frame, past the internal surface and into the free cross-sectional area defined by the respective internal surface of each metal frame, such that said projecting edge member prevents both the ctalyst and the gasket from extendingn past the plane defined by the forward side edge of each of said metal frames.

15. An apparatus according to claim 14 wherein both the internal and the external surfaces of said metal frames are rectangular in cross-section and said metal frames each include four frame elements which form said rectangular metal frames.

16. An apparatus according to claim 15 wherein there are two recesses per metal frame with each one on one of two of the four frame elements forming each of said metal frames and there are two of said projections per metal frame one each on the remaining two of the four frame elements of each of said metal frames and said projections being positioned on the sides opposite to the sides where the recesses are located.

17. An apparatus according to claim 15 wherein there are four of said projecting edge members per each metal frame, one on each frame element of the rectangular frame members.

18. A catalyst package, comprising:

at least one catalyst element having a first end and a second end and an external surface therebetween;

at least one gasket member having an internal and an external surface, said gasket member adapted to have its internal surface fit over at least one of said first and second ends such that the external surface of said catalyst is completely surrounded by said gasket;

at least one frame member having an internal and an external surface, said frame member adapted to have its internal surface fit over said at least one gasket so as to completely surround the external surface of said at least one gasket, said frame member having formed in its external surface at least one recess and said frame member having extending from its external surface at least one projection in a form which is engageable in a form fitting manner with any recess in the shape of the at least one recess formed in the external surface of said frame member.

* * * * *

UNITED STATES PATENT AND TRADEMARK OFFICE

CERTIFICATE OF CORRECTION

PATENT NO. : 4,859,428

DATED : August 22, 1989

INVENTOR(S) : Reinhold Brand et al

It is certified that error appears in the above-identified patent and that said Letters Patent is hereby corrected as shown below:

Column 1, line 7, "four cornered" should read --four-cornered--; line 9, "combustio" should read --combustion--; line 15, "conditionsn" should read --conditions--; line 26, "monolitthic" should read --monolithic-- and "ctalyst" should read --catalyst--; line 39, "are" should read --area--; line 45, "he" should read --the--; line 58, "momolith" should read --monolith from the direction of the front side(s) of the monolith,--; Column 2, line 25, "elementn" should read --element--; line 30, "comprsing" should read --comprising--; line 42, "thet" should read --the--; line 47, after "be" insert --coated on its surfaces with a catalyst composition in accordance with the state of the art. The monolith can be--; line 50, "elasltic" should read --elastic--; line 60, "secttion" should read --section--;

UNITED STATES PATENT AND TRADEMARK OFFICE

CERTIFICATE OF CORRECTION

PATENT NO. : 4,859,428

DATED : August 22, 1989

INVENTOR(S) : Reinhold Brand et al

It is certified that error appears in the above-identified patent and that said Letters Patent is hereby corrected as shown below:

line 64, "dimensionsn" should read —dimensions—; Column 3, line 1, "projecttions" should read —projections—; line 10, "aforementioed" should read —aforementioned—; line 25, "apparentn" should read —apparent—; line 38, "ouside" should read —outside—; line 42, after surface insert —area—; line 60, "nto" should read —into—; line 61, "fram e" should read —frame—; Column 4, line 34, "witth" should read —with—; line 46, "leasat" should read —least—; Column 5, line 1, "oed" should read —oned—; line 12, "flrame" should read —frame—; line 14, "monolithi" should read —monolithic—; Column 6, line 10, "ctalyst" should read —catalyst—; line 11, "extendingn" should read —extending—.

Signed and Sealed this

Nineteenth Day of December, 1989

*Attest:*

JEFFREY M. SAMUELS

*Attesting Officer*

*Acting Commissioner of Patents and Trademarks*